US009843881B1

(12) United States Patent
Oates, III et al.

(10) Patent No.: US 9,843,881 B1
(45) Date of Patent: Dec. 12, 2017

(54) SPEAKER ARRAY BEHIND A DISPLAY SCREEN

(71) Applicant: Amazon Technologies, Inc., Seattle, WA (US)

(72) Inventors: Robert Harvey Oates, III, Redmond, WA (US); Kevin Kalima Ashman, Seattle, WA (US)

(73) Assignee: Amazon Technologies, Inc., Seattle, WA (US)

( * ) Notice: Subject to any disclaimer, the term of this patent is extended or adjusted under 35 U.S.C. 154(b) by 15 days.

(21) Appl. No.: 14/954,827

(22) Filed: Nov. 30, 2015

(51) Int. Cl.
*H04S 7/00* (2006.01)
*H04R 5/02* (2006.01)

(52) U.S. Cl.
CPC ..... *H04S 7/301* (2013.01); *H04R 5/02* (2013.01); *H04S 7/30* (2013.01); *H04R 2499/15* (2013.01); *H04S 2400/13* (2013.01)

(58) Field of Classification Search
CPC .. H04S 7/301; H04S 7/30; H04R 5/02; H04R 2499/15; H04R 2400/13
USPC ..... 381/27, 305, 306; 348/462, 480–484
See application file for complete search history.

(56) References Cited

U.S. PATENT DOCUMENTS

2005/0147257 A1* 7/2005 Melchior ..... H04N 5/2224 381/61

FOREIGN PATENT DOCUMENTS

KR EP 2268012 A2 * 12/2010 ..... H04N 5/607

OTHER PUBLICATIONS

"Voronoi diagram"; https://web.archive/org/web/20151121023709/https://en.wikipedia.org/wiki/Voronoi_diagram; Wikipedia; Nov. 21, 2015 accessed Mar. 14, 2017; 8 pages.

* cited by examiner

*Primary Examiner* — David Ton
(74) *Attorney, Agent, or Firm* — Baker & Hostetler LLP

(57) ABSTRACT

A content presentation system including a display screen and an array of speakers behind the display screen is described herein. In some examples, speaker-associated screen areas, the volume of a sound, and a screen location of a sound source may be used to determine one or more speakers that are associated with the sound. For example, the volume of a sound and the screen location of a sound source may be used to determine a sound range for the sound that may be used to associate one or more speakers with the sound. In some examples, upon determination of the sound range, one or more speaker-associated screen areas that are wholly or partially included within the sound range may then be identified. Each speaker that is represented by an identified speaker-associated screen area may then be associated with the sound.

17 Claims, 10 Drawing Sheets

SPEAKER ARRAY BEHIND A DISPLAY SCREEN

BACKGROUND

There has recently been a rapid increase in the quantity and variation of content that may be presented electronically. For example, devices such as monitors, laptops, tablets, phones, televisions, and others may be used to display content such as video games, movies, application content, web pages, and other audio, graphical, image and/or video content. In many cases, in order to enhance user appreciation of the presented content, various positional audio implementations have been developed. Many current implementations of positional audio focus on an array of several speakers surrounding the listener in a room, or by using expensive headphones to simulate a surround sound system. This approach sometimes works well for certain scenarios in which the listener is correlated to a camera or other point of view and the speakers are positioned around the listener in a three-dimensional space. For many types of content, however, the camera does not represent a traditional point of view and, therefore, makes a poor audio listener. Some common examples of these types of content include video games with an overhead camera view, such as certain multiplayer online battle arena (MOBA) games, real-time-strategy games, action role-playing games (RPGs), and other video games, programs, media, and content items. In these and other cases, traditional surround sound setups may fail to perform in a meaningful manner, for example because it may be difficult to map the notion of a two-dimensional listener to three-dimensional surround hardware setups.

BRIEF DESCRIPTION OF DRAWINGS

The following detailed description may be better understood when read in conjunction with the appended drawings. For the purposes of illustration, there are shown in the drawings example embodiments of various aspects of the disclosure; however, the invention is not limited to the specific methods and instrumentalities disclosed.

DETAILED DESCRIPTION

Figure 1:
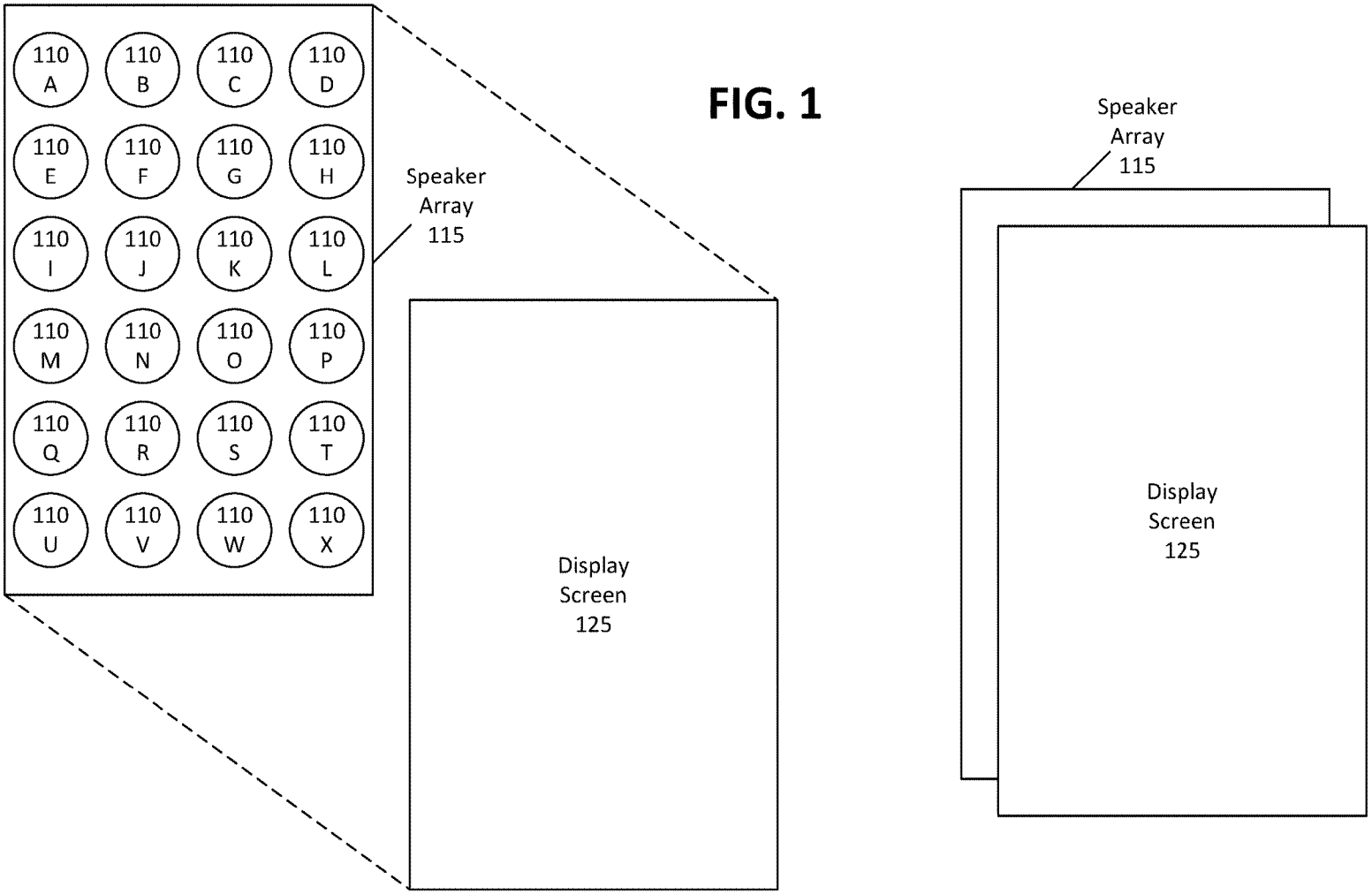
FIG. 1 is a diagram illustrating a first example speaker array behind a display screen that may be used in accordance with the present disclosure.

A content presentation system including a display screen and an array of speakers behind the display screen is described herein. In some examples, the speakers may be used to play sounds associated with virtual objects, such as characters, weapons, vehicles, or other objects in a video game, movie, or other content. Also, in some examples, the speakers may be used to provide feedback associated with user input, such as a touch on a touchscreen, a mouse click, a selection of an object, and other input. These and other example uses for the disclosed speaker arrangements are described in detail below. In some examples, positioning of speakers behind the display screen may enhance user appreciation of content by creating a more realistic and intuitive audio experience. In particular, in some examples, the disclosed speaker positioning techniques may allow sound to be provided at or near a screen location of a virtual object and/or input location with which the sound is associated. For example, in some cases, the disclosed speakers may play a sound that is generated by a character or other object in a video game, and the sound may be played on one or more speakers at or near the object's position on the display screen. In another example, the disclosed speakers may play a sound that is provided as feedback when a user selects an object by touching the object on a touchscreen, and the sound may be played on one or more speakers at or near the same location as the user's touch. In contrast to these examples, conventional surround sound systems may often play sounds on speakers that are not located at or near any associated object or input screen location, such as speakers that are located behind a user or otherwise not in the user's field of view.

In some examples, the speaker array may be manufactured and distributed in combination with a particular display device, and the number and locations of the speakers, for example with respect to a display screen, may be identified and stored within device memory or be otherwise accessible, for example based on a model number or other identification information associated with the device. In other examples, the locations of each speaker may not necessarily be known simply based on the identity of a display device. This may occur, for example, when the speaker array is distributed and purchased separately from a display and combined with the display after distribution. In these and other cases, the locations of the speakers, for example with respect to a display screen, may be determined, for example, based on information provided by a user, or based on triangulation or other known audio source location determination techniques. Once the locations of the speakers with respect to a display have been identified or determined, they may be used to determine a speaker-associated screen area for each of the speakers. For example, in some cases, a speaker-associated screen area may include an area of the display screen that overlays or is otherwise associated with a respective speaker.

In some examples, the speaker-associated screen areas, the volume of a sound, and a screen location of a sound source may be used to determine one or more speakers that are associated with the sound. For example, the volume of a sound and the screen location of a sound source may be used to determine a sound range for the sound that may be used to associate one or more speakers with the sound. In some examples, upon determination of the sound range, one or more speaker-associated screen areas that are wholly or partially included within the sound range may then be identified. Each speaker that is represented by an identified speaker-associated screen area may then be associated with the sound. For each associated speaker, a respective speaker-associated volume may then be determined for the sound. For example, associated speakers that are closer to the sound source may be assigned a higher speaker-associated volume, while associated speakers that are further from the sound source may be assigned at a lower speaker-associated volume.

As set forth above, in some cases, a sound source may include one or more virtual objects, such as characters or weapons, associated with the generated the sound. In these cases, the screen location of the sound source may, for example, be determined based on information such as an associated object's location in a two-dimensional or three-dimensional model associated with a virtual area that is displayed on the screen. For example, in some cases, the object's screen location may be determined based, at least in part, on the object's location in the two-dimensional or three-dimensional model and on viewport information associated with a virtual viewport through which the virtual area is displayed on the display screen. The viewport information may include, for example, the location, angle, direction, pan, tilt, and other characteristics of the viewport in association with the virtual area. As also set forth above, in some cases, a sound source may include user input, such as a touch on a touchscreen, a mouse click, a selection of an object, and other input. In these cases, the screen location of the sound source may, for example, be determined based on information from various user input components, such as a touchscreen, mouse, camera, touchpad, or other input components.

Figure 2:
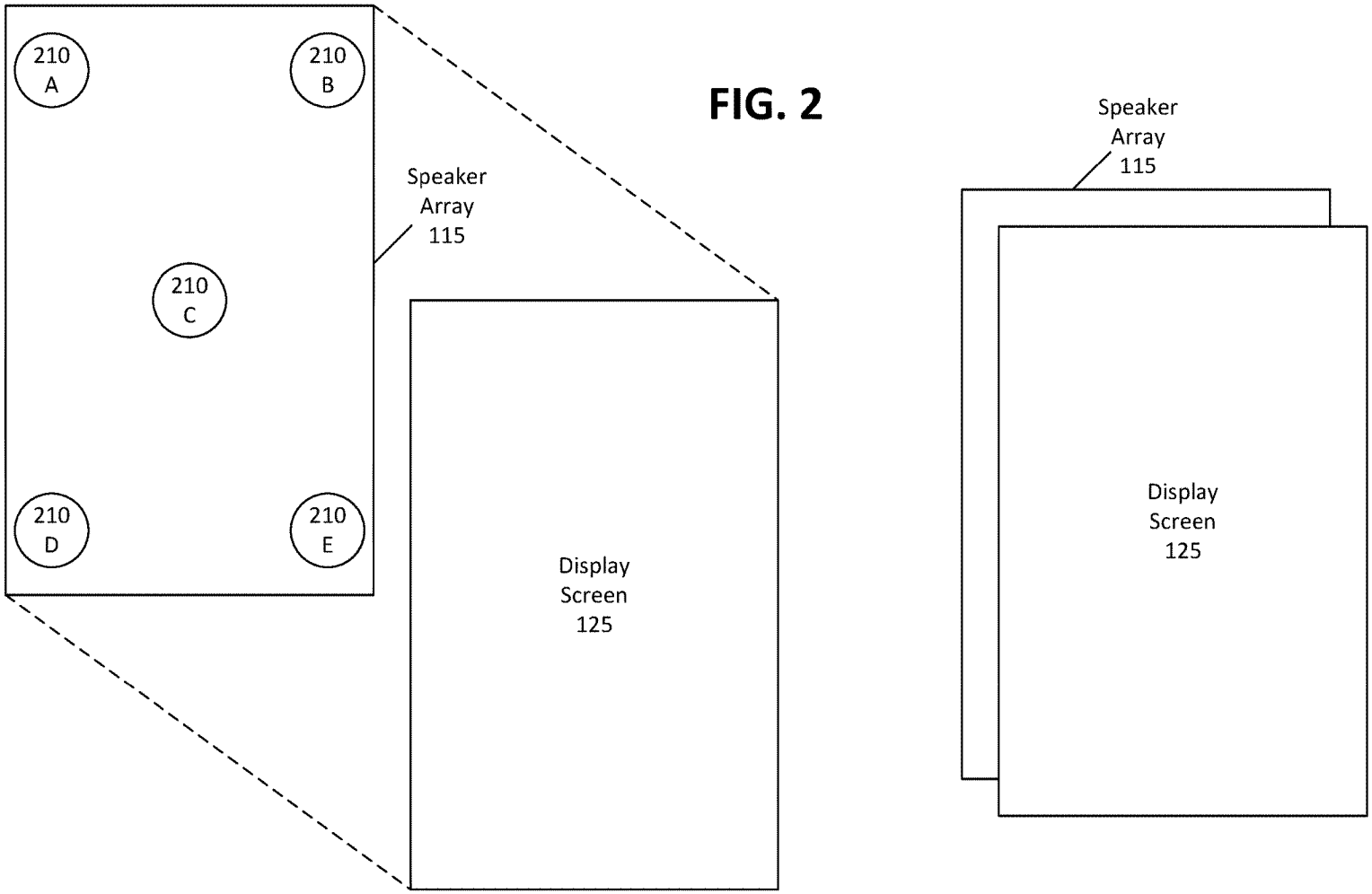
FIG. 2 is a diagram illustrating a second example speaker array behind a display screen that may be used in accordance with the present disclosure.

FIGS. 1 and 2 are diagrams illustrating example speaker arrays behind a display screen that may be used in accordance with the present disclosure. FIG. 1 shows an example speaker array that includes twenty-four speakers, while FIG. 2 shows an example speaker array that includes five speakers. It is noted that the speaker arrays shown in FIGS. 1 and 2 are merely provided as examples and that a speaker array in accordance with the present disclosure may include any number of speakers arranged at any distance, angle, and direction with respect to one another.

Referring now FIG. 1, it is seen that speaker array 115 includes twenty-four speakers 110A-X. In the example of FIG. 1, speaker array 115 includes four evenly spaced columns and six evenly spaced rows. As also shown in FIG. 1, display screen 125 overlays a speaker array 115. In the examples of FIGS. 1 and 2, speaker array 115 is positioned parallel to display screen 125. As should be appreciated, the front of the display screen 125 (i.e., the portion of the display screen that displays graphics, etc.) will typically face toward the viewer while the display is being viewed, and the front of speaker array 115 (i.e., the portion of the speaker array from which sound is principally emitted) will typically also face toward the viewer in the same direction as the front of the display screen 125. In the example of FIG. 1, each of speakers 110A-X is positioned behind the display screen such that there is at least one point on the display screen through which a straight line (e.g., a real or imaginary line) perpendicular to a surface of the front of the display screen would eventually intersect both the point on the display screen and a point on each of speakers 110A-X. It is noted that there is no requirement that every portion of an entire speaker in a behind screen speaker array must be positioned completely behind the display screen. For example, in some cases, some portions of one or more speakers may extend slightly outward from the display screen in one or more directions.

Display screen 125 may be included in any device that includes a display, such as a monitor, laptop, tablet, phone, television, and others. Speaker array 115 may also be included in and/or attached to any device that includes a display. As set forth above, in some examples, the speaker array 115 may be manufactured and distributed in combination with a device that includes display screen 125. In other examples, the speaker array 115 may be distributed and purchased separately from display screen 125. In some cases, the speaker array 115 and/or any of its included speakers 110A-X may be attachable to and/or detachable from display screen 125 using clamps or other attachment components. Also, in some cases, locations, positions and/or orientations of one or more speakers 110A-X may sometimes be adjustable, for example via screws, knobs, sliders, and the like. In some examples, the speaker array 115 may include one or more boards or other physical components to which one or more of speakers 110A-X are attached. Also, in some examples, the speakers 110A-X may be separate components that are not, for example, attached to one or more boards.

Referring now to FIG. 2, another example of speaker array 115 is shown including five speakers 210A-E. In the example of FIG. 2, speaker array 115 includes four corner speakers 210A, 210B, 210E and 210E and a center speaker 210C. As will be described in detail below, by including a greater number of speakers, the speaker array of FIG. 1 may, in some examples, enable sounds to be played by speakers that are closer to screen locations of respective sound sources, thereby enhancing the user experience and providing a more realistic sound representation. Additionally, in some examples, by including a lesser number of speakers, the speaker array of FIG. 2 may be advantageous by, for example, reducing the expense and weight of a device while still substantially enhancing the user experience and providing realistic sound representation. It is once again noted that other speaker arrangements may be employed with different numbers of speakers arranged at different distances, angles, and directions with respect to one another.

Figure 3:
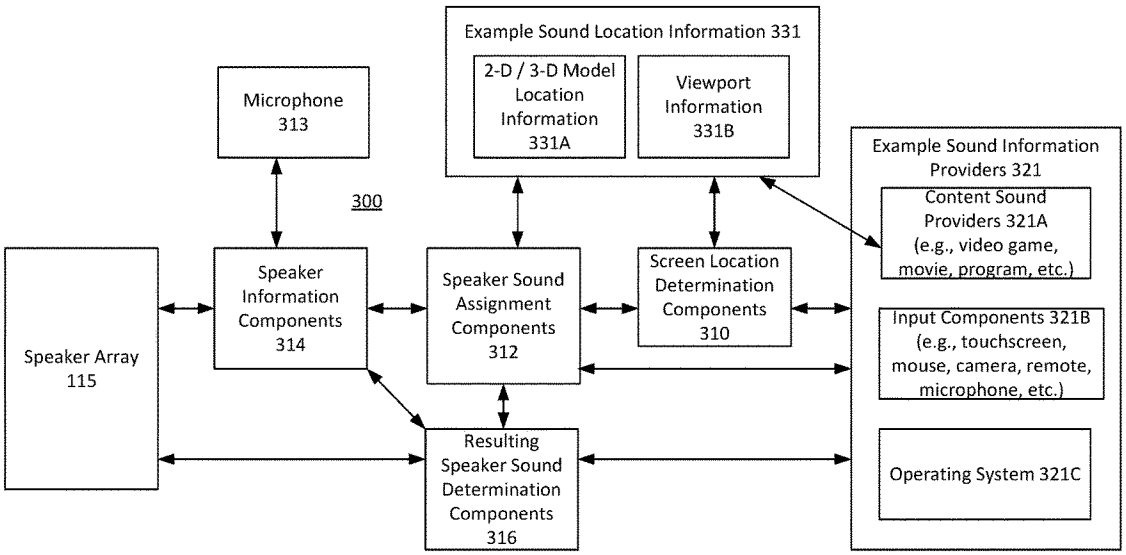
FIG. 3 is a diagram illustrating an example speaker operation system that may be used in accordance with the present disclosure.

Some example systems and techniques for controlling behind screen speaker arrays, such as the examples of FIGS. 1 and 2, will now be described in detail. In particular, FIG. 3 is a diagram illustrating an example speaker operation system 300 that may be used in accordance with the present disclosure. In some examples, one or more of the various components shown in FIG. 3 may be included within and/or distributed across any layers of an audio processing system, such as audio middleware, various audio application programming interfaces (API's), audio drivers, firmware, and/or hardware.

As shown, system 300 includes a speaker array 115, such as the examples shown in FIGS. 1 and 2. System 300 also includes speaker information components 314, which may generally obtain, maintain, access, and provide information about the speaker array 115 and its included speakers. For example, speaker information components 314 may obtain information regarding a number of speakers in speaker array 115 and their respective locations, such as their locations relative to display screen 125. As set forth above, in some examples, speaker number and location information may be determined or known based on a type of device in which a speaker array is included and, in some cases, may be included within or readily accessible to speaker information components 314. In some examples, speaker information components 314 may receive user input indicating a number of speakers in the speaker array and their respective locations, for example with respect to a display screen. For example, to indicate a speaker location, a user may measure a distance or indicate a size or type of part used to attach the speaker. In one specific example, the rear of a display may include visual markings indicating locations at which speakers may be placed and respective location information.

In yet other examples, speaker information components 314 may perform triangulation or other known audio source location determination techniques to determine the location of the speakers in the array 115. For example, in some cases, speaker information components 314 may send pulses and/or instructions to various speakers to play specified sounds at specified volumes and/or times. Speaker information component 314 may employ a microphone 313 to listen for the played sounds and to collect audio data regarding the sounds (e.g., volume, timing, etc.). In some examples, microphone 313 may have a location that is known to speaker information components 314, and the microphone's location and the collected audio data may be used to determine the location of the speakers.

Also, in some examples, the microphone may be placed at a location at or near a human listener. This may, in some cases, assist in obtaining information that can be used to adjust the volume or other characteristics of one or more speakers. For example, in some cases, a human listener may not be located directly in front of a center of the display screen, but rather offset in one or more directions from the center of the display screen. It may sometimes be advantageous to adjust the volumes of one or speakers to account for the offset position of the listener. For example, if the listener is positioned to the right of the display screen, then it may sometimes be advantageous to decrease the volumes of speakers closer to the user (e.g., speakers on the right side of the display screen) and to increase the volumes of speakers further from the user (e.g., speakers on the left side of the display screen). Moreover, certain physical components and materials, such as certain plastics, metals, and others, may sometimes be positioned between the one or more speakers and the listener, and these components and materials may sometimes affect various audio characteristics (e.g., volume, frequency, pitch, etc.) of played sounds as those sounds are heard by the listener. Accordingly, in some examples, speaker information components 314 may send pulses and/or instructions to various speakers to play specified sounds at specified volumes and/or times, and microphone 313 may be placed at or near a human listener to collect audio data regarding the played sounds. This audio data may then be used to adjust sound characteristics output by one or speakers. For example, if a particular component or material positioned between a particular speaker and the human listener is causing sound from that speaker to be heard by the listener at a lower than desired volume, then that speaker may be adjusted to play at a higher volume.

As described above, in some examples, speaker information components 314 may determine locations of speakers in the speaker array 115, for example with respect to the display screen. In some examples, speaker information components 314 may use this location information to determine speaker-associated screen areas for each of the identified speakers. A speaker-associated screen area is a portion of the display screen that is associated with one or more respective speakers. In some examples, a speaker-associated screen area may be a portion of the display screen that overlays a respective speaker. It is noted however, that speaker-associated screen areas need not necessarily be equivalent to the portion of the display screen that overlays respective speakers and may include smaller or larger portions of the display screen. In some examples, speaker-associated screen areas may include only a single point or other small screen area, while, in other cases, speaker-associated screen areas may include larger areas. In some examples, speaker-associated screen areas may overlap with one another such that a single point on the display screen may be included in multiple speaker-associated screen areas. In other examples, speaker-associated screen areas may be non-overlapping such that no single point on the display screen may be included in multiple speaker-associated screen areas. In some examples, the entire display screen may be divided up into speaker-associated screen areas such that every point or portion of the display screen is included within at least one speaker-associated screen area. For example, in some cases, each speaker-associated screen area may include all points on a display screen that are closer to a respective speaker than to any other speaker. In other examples, there may be various points or portions of the display screen that are not included within any speaker-associated screen areas.

As also shown in FIG. 3, system 300 also includes example sound information providers 321, which are components that generally provide information associated with various sounds that are played by the speaker array 115. In FIG. 3, example sound information providers 321 include content sound providers 321A, input components 321B, and operating system 321C. As will be described in detail below, example sound information providers 321 may provide information regarding audio characteristics of a sound, such as its volume, tone, pitch, frequency, and other audio data or information. In some examples, example sound information providers 321 may provide pointers to locations or other data in library or other data store that includes audio information for various different sounds. Additionally, example sound information providers 321 may provide information that may be used to determine a screen location associated with a sound, such as screen coordinates, model and viewport information, user input information, and the like. Various examples of sound information that may be obtained from different sound information providers will now be described in detail.

In particular, content sound providers 321A may include one or more content items, such as a video game or other application or program, a movie or other media item, and others. In some examples, such as in the case of many video games, content sound providers 321A may generate and maintain an associated virtual area that includes various virtual objects, such as characters, weapons, vehicles, objects of nature, and the like. Also, in some examples, these virtual objects may generate various sounds that are wholly or partially played by speakers within speaker array 115. For example, in many video games, characters may speak words and other sounds, guns may generate sounds upon being fired, car engines and horns may make various sounds, and many other virtual objects may make various other associated sounds. Additionally, sounds may be generated when various virtual objects collide, crash, and otherwise interact with one another. Thus, in these and other examples, one or more virtual objects may be considered to be a sound source that is wholly or partially associated with the generation of one or more associated sounds.

Additionally, in some examples, video games and other content sound providers 321A may generate and maintain a two-dimensional or three-dimensional model associated with their respective virtual areas. For example, two-dimensional video games are rendered based on respective two-dimensional models, while three-dimensional video games are rendered based on respective three-dimensional models. In these cases, a view of the virtual area that is displayed on a display screen may be rendered based on a viewport, such as a virtual camera, through which the respective two-dimensional or three-dimensional model is viewed. For example, in some cases, information regarding the two-dimensional or three-dimensional model and the corresponding viewport may be provided to a graphics processing unit (GPU) and other components that are used to render the resulting content on the display screen.

In some examples, the above described information may also be provided by content sound providers 321A for purposes of determining a screen location of various sound sources associated with one or more virtual objects. In particular, in the example of FIG. 3, content sound providers 321A may provide example sound location information 331, which includes model location information 331A and viewport information 331B. Specifically, model location information 331A may include information regarding a location of a sound source within a two-dimensional or three-dimensional model of a virtual area. As a particular example, for gunshot sound, the gun may be a sound source and the model location information 331A may include information regarding a location of the gun within the two-dimensional or three-dimensional model, such as location coordinates or other types of location information. Additionally, viewport information 331B may include information associated with a virtual camera or other viewport through which the model is viewed, such as the location, angle, direction, pan, tilt, and other characteristics of the viewport in association with the model and virtual area. In some examples, the screen location of a sound source may be determined based on model location information 331A and viewport information 331B. For example, in the case where a sound is a gunshot and a sound source is the above-described gun, the screen location of the gun may be determined based on the location of the gun within the two-dimensional or three-dimensional model and the corresponding viewport information.

In addition to information associated with virtual objects, example sound information providers 321 may also provide information regarding various user input, and other input, actions, or events. For example, input components 321B may include components such as a touchscreen, mouse, camera, remote control or other controller, microphone and the like. Input components 321B may provide information regarding user input that causes or is otherwise associated with a sound. For example, in some cases, a user may select a virtual object within a program or other interface, such as a menu item or icon, and audio and other feedback may be provided to confirm the user's selection. As another example, a user may select a virtual object within a video game, such as weapon or character, and audio or other selection feedback may similarly be provided. As yet another example, a user may select a particular screen area as a location to move, drop, or insert a virtual object, and audio or other selection feedback may similarly be provided to confirm the selected location. As should be appreciated, the location and selection of these screen locations may be performed using a variety of different techniques, such as a touch on a touchscreen, a movement and click of a mouse or other controller, one or more gestures, and the like. As should also be appreciated, operating system 321C and/or content sound providers 321 may cooperate with input components 321B to provide information associated with the user input. For example, when a user selects a weapon in a video game, location information for the weapon may, in some cases, be combined with user input information in order to determine the location of the weapon and its selection by the user. As another example, operating system 321C may be employed to provide various information associated with input and audio feedback, such as audio information regarding the respective played sounds, as well as receiving, maintaining and providing information from the input components 321B and their respective drivers and other components.

In some examples, in addition to audio feedback, other feedback, such as visual and/or haptic feedback may also be provided in association with user input or other input, actions, or events. For example, a device, component, or other portion of a device may rumble, vibrate, or provide other haptic feedback, for example to indicate a touch, selection, movement, or other input, actions, or events. In addition, as another example, a selected or otherwise associated virtual object may light up, flash, be enlarged, or otherwise change in visual appearance to provide further visual feedback.

Thus, as set forth above, example sound information providers 321 may provide sound information associated with sounds that are played by speaker array 115. As shown in FIG. 3, sound information provided by sound information providers 321 may be received by screen location determination components 310, which may use the provided sound information to determine screen locations associated with various sound sources. For example, as described above, some content sound providers 321A, such as certain video games, may provide sound location information 331, which may include model location information 331A and viewport information 331B. As set forth above, model location information 331A may indicate a location of a sound source, such as one or more virtual objects, within a two-dimensional or three-dimensional model associated with a displayed virtual area, while viewport information 331B may provide information associated with a viewport (e.g., location, angle, direction, pan, tilt, etc.) with respect to the model. Screen location determination components 310 may then use this information to calculate a screen location of the sound source, such as image and/or screen coordinates. Screen location determination components 310 may also receive additional information, such as from operating system 321C or other components, for determining a sound source screen location, such as information regarding a size and shape (e.g., length and width information) of the display screen and a size, shape, or position of various windows or other areas of the display screen and the associated content displayed in such windows or areas.

Screen location determination components 310 may also, in some examples, receive input regarding a screen location associated with user input, such as a selection of a menu item, icon, weapon, character, or drag, drop, or other location. As set forth above, such input may be provided, for example, from any or all of content sound providers 321A, input components 321B, operating system 321C or other components, and such input may include screen and/or image coordinates or other location information. It is noted that, in some examples, screen location determination components may be wholly or partially integrated into any or all of example sound information providers 321 and other components.

The sound source screen locations determined by screen location determination components 310 may be provided to speaker sound assignment components 312, which may use the determined sound source screen locations to assign associated sounds to one or more speakers. In addition to sound source screen locations, speaker sound assignment components 312 may also receive information from sound information providers 321, such as volume and other audio information for various sounds. Furthermore, speaker sound assignment components 312 may also receive information from speaker information components 314, such as speaker-associated screen areas and other location information for the speakers in speaker array 115. In some examples, speaker sound assignment components 312 may use the above described and other provided information to determine, for a particular sound, one or more speakers for association with the particular sound. These determined associated speakers may then be assigned to play, for example, an associated resulting sound.

In some examples, the associated speakers may be determined by first determining a sound range associated with a particular sound. The sound range is a screen area surrounding or partially surrounding a sound source that is used to associate one or more speakers with an associated sound. In some examples, the sound range may be determined based, at least in part, on the screen location of the sound source and the volume of an associated sound. In some examples, the size of a sound range may be determined primarily based on the volume of sound. In particular, sounds with higher volumes may generally tend to be detectable at greater distances from their sources and may, therefore, tend to have lager sound ranges. By contrast, sounds with lower volumes may generally tend to be detectable only at lesser distances from their sources and may, therefore, tend to have smaller sound ranges. In some examples, a sound range may be a circular area that surrounds a respective sound source, with the sound source at the center of the circular sound range. This may be particularly likely when a sound is generated in a virtual area that has no or few sound-obstructing elements, such as buildings, walls, mountains, and other sound-obstructing or sound-blocking elements. It is noted, however, that a sound range may not always be a perfectly circular area. For example, in some cases, one or more sound-blocking or sound-resistant elements may block or reduce the extension of the sound range from the sound source. For example, consider the scenario where a dog is barking inside of a rectangular dog house. In some examples, the sound range may have a substantially rectangular shape that reflects the rectangular shape of the dog house. Also, in some examples, if the dog house has a small opening through which the dog may enter and exit, then the sound range may extend further from the dog in the direction of the opening than in other directions.

Upon determination of a sound range for the associated sound, the sound range may then be used to determine one or more speakers associated with a sound. In particular, as set forth above, speaker sound assignment components 312 may receive, from speaker information components 314, speaker-associated screen areas and other location information for the speakers in speaker array 115. In some examples, speaker sound assignment components 312 may compare the determined sound range of a sound to the speaker-associated screen areas of the speakers in the speaker array 115. One or more speaker-associated screen areas that are at least partially included within the sound range may then be identified. In some examples, each speaker having a respective identified speaker-associated screen area that is at least partially included within the sound range may then be associated with the sound.

In some examples, upon identifying the speakers associated with a sound, speaker sound assignment components 312 may also determine a respective speaker-associated volume for the sound. In some cases, the speaker associated volume may be determined based, at least in part, on the distance between the speaker-associated screen area and the sound source. For example, in some cases, associated speakers that are closer to the sound source may be assigned a higher speaker-associated volume, while associated speakers that are further from the sound source may be assigned a lower speaker-associated volume. It is noted, however, that the speaker associated volume may not necessarily be determined based strictly upon the distance between the speaker-associated screen area and the sound source and that other factors may be considered. For example, if a sound-obstructing or sound-blocking virtual object is positioned between a speaker-associated screen area and a sound source, then the associated speaker may sometimes play the sound at a lower volume than would otherwise be determined based strictly on distance. Also, in some examples, the volume of the sound may be determined based, at least in part, on the number of associated speakers that are selected for playing of the sound. For example, in some cases, if a higher quantity of speakers is selected to play a sound, then the sound may be played by each speaker at a lower volume. By contrast, if a lower quantity of speakers is selected to play a sound, then the sound may be played by each speaker at a higher volume.

Another characteristic based upon which the speaker-associated volumes for a sound may sometimes be determined is a virtual distance associated with the sound. For example, in some cases, certain virtual objects or other sound sources may have varying amounts of virtual distances respective to a viewport through which a displayed virtual area is viewed. In some examples, a virtual distance of a sound source with respect to the viewport may be determined based on model location information 331A and viewport information 331B. In some cases, sound sources having a greater depth and/or other distance from the viewport may generally be assigned lower speaker-associated volumes, while sound sources having a lesser depth and/or other distance from the viewport may generally be assigned higher speaker-associated volumes. In addition to distance, if a virtual object with high sound-obstructing or sound-blocking properties is determined to be positioned between the viewport and the sound source, then this may also cause the speaker-associated volumes to be reduced.

As should be appreciated, however, not all sound sources may have an associated virtual distance or may otherwise not have a virtual distance considered in determination of speaker-associated volumes. For example, in some cases, various user inputs, such as a selection of a menu item, desktop icon, drag and drop screen location, and the like, may be considered to occur in the depth plane of the screen (e.g., a neutral or zero depth plane) as opposed to, for example, certain virtual objects in a two-dimensional or three-dimensional model of a video game. Also, in some cases, a user may select a virtual object that has a virtual depth, such as a selection of a character or a weapon in a video game. It is noted, however, that audio feedback associated with the user's selection of the virtual object may, but need not necessarily, be assigned the same virtual depth as the selected virtual object. For example, if a user selects a character that is positioned at a depth of fifty feet from a viewport, the selection may, in some cases, be assigned a depth of fifty feet or may, in other cases, be assigned a depth of zero or another assigned depth.

Figure 4A:
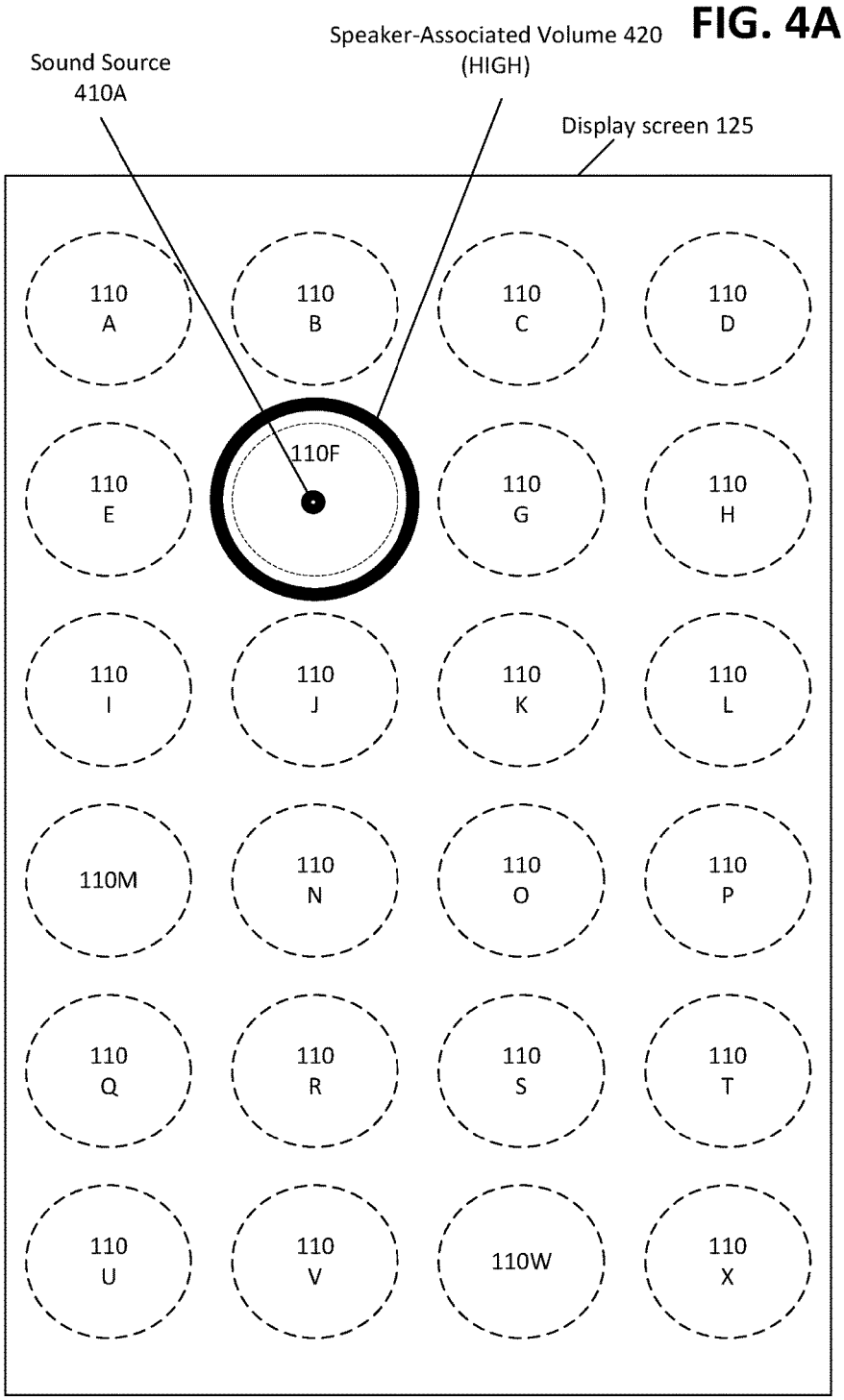
FIGS. 4A-4C are diagrams illustrating example speaker sound and volume assignments for the example speaker array of FIG. 1 that may be used in accordance with the present disclosure.
Figure 4B:
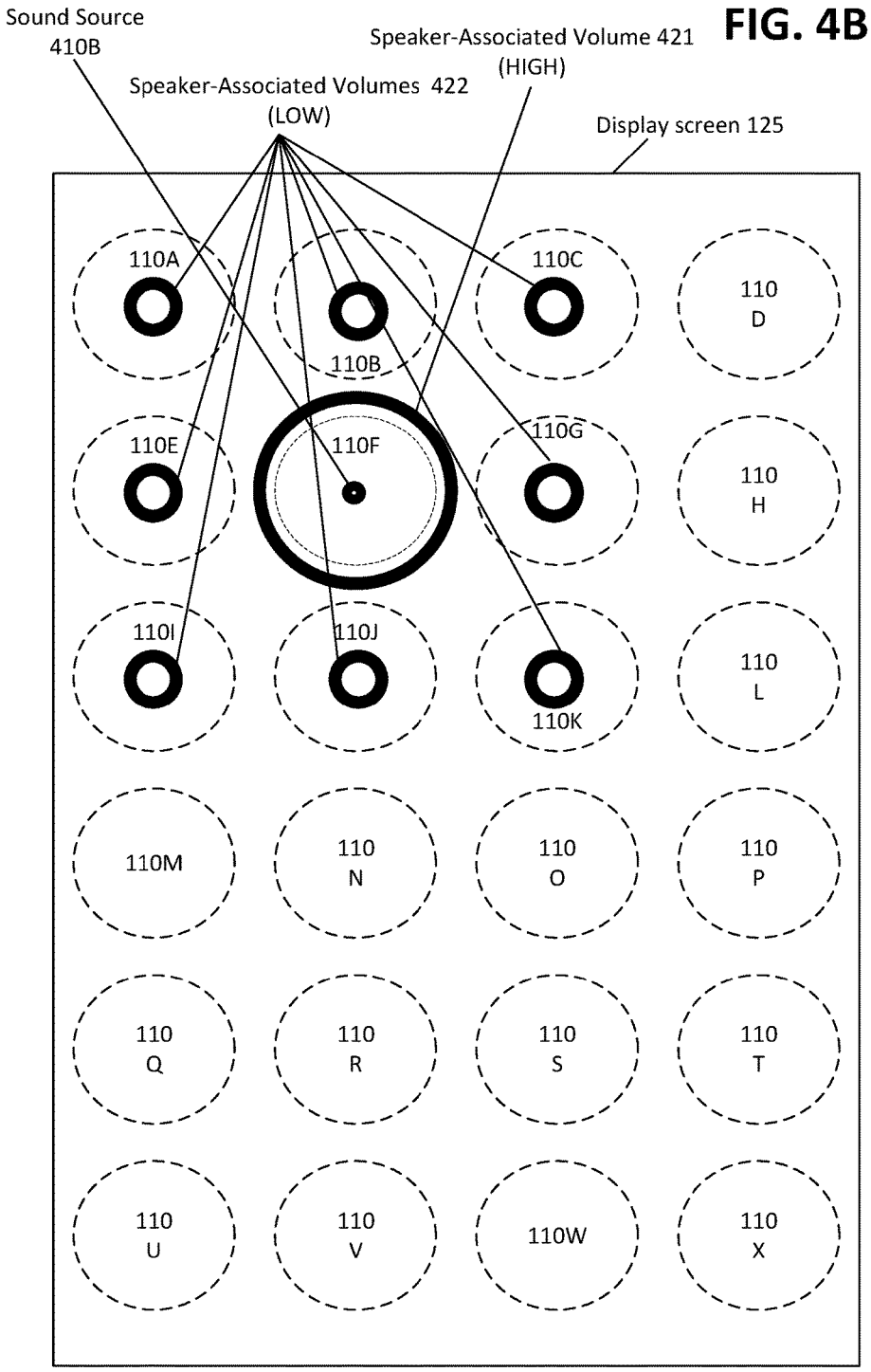
Figure 4C:
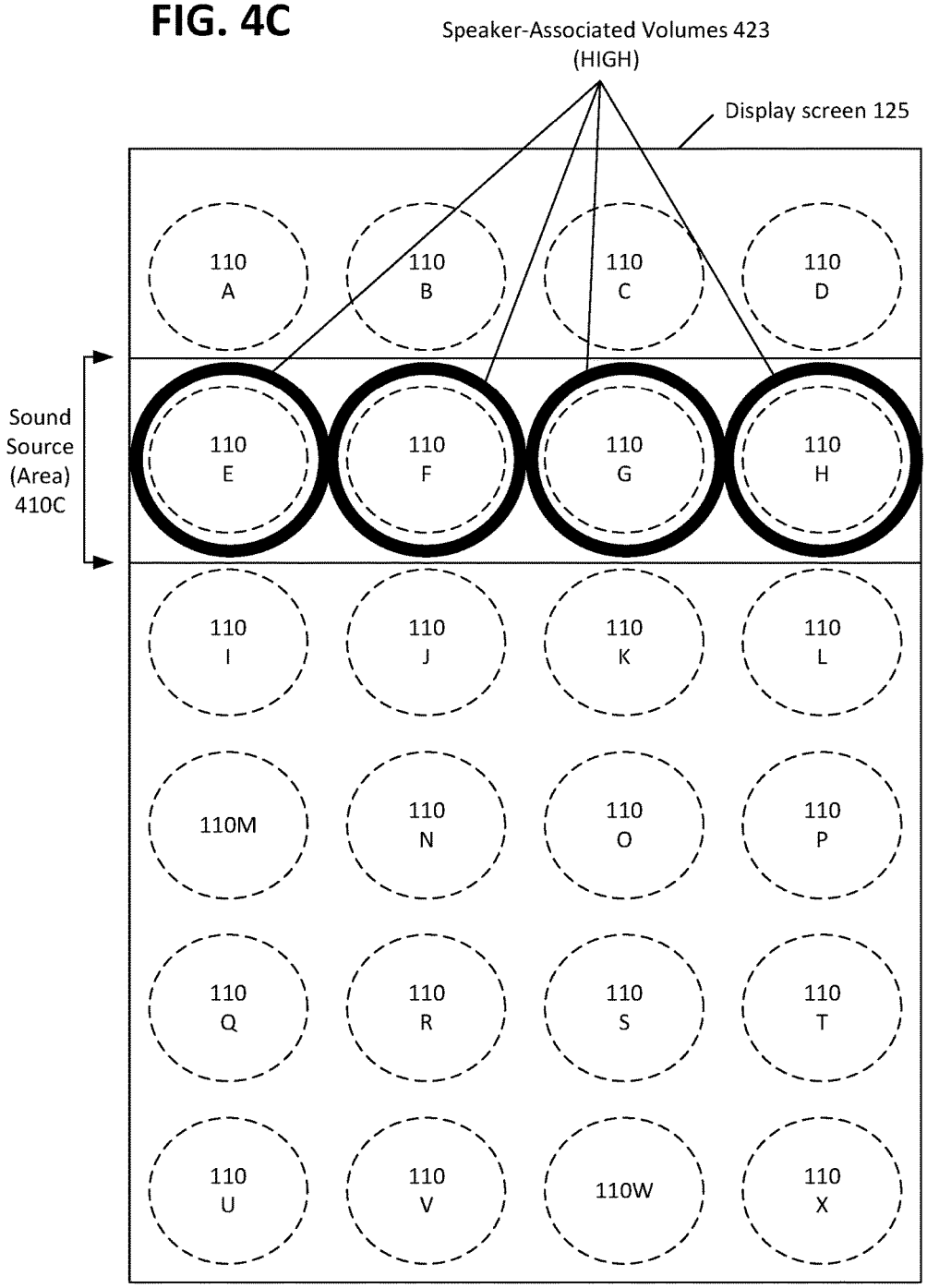

Some examples of the above described speaker sound assignment and volume assignment techniques will now be described in detail with respect to FIGS. 4A-C, 5, and 6. In particular, FIGS. 4A-4C are diagrams illustrating example speaker sound and volume assignments for the example speaker array of FIG. 1 that may be used in accordance with the present disclosure. As shown in FIG. 4A, display screen 125 overlays a speaker array including twenty-four speakers 110A-X. It is noted, however, that speakers 110A-X are depicted using dashed lines because they are positioned behind the display screen 125 and are, therefore, not visible to a viewer looking at the front of the display screen 125. As should be appreciated, the speaker arrangement shown in FIG. 4A is identical to the speaker arrangement depicted previously in FIG. 1.

As also shown in FIG. 4A, a sound source 410 is determined to have a screen location indicated by the associated small circular shape shown in FIG. 4A. Sound source 410 may include any of the above described or other example sound sources, such as one or more virtual objects (e.g., characters, weapons, vehicles) in a video game or other application, a location of a received or indicated user input, or other event, action, entity or location. As a specific example, sound source 410 may be a gun in a video game that is fired by a character, and the gun may be displayed at the location in which the sound source 410 is positioned in FIG. 4A. As another specific example, a user may select a menu item that is displayed at the location in which the sound source 410 is positioned in FIG. 4A, and the sound source 410 may represent audio feedback that is used to confirm the user's selection of the menu item.

In the example, of FIG. 4A, there is only a single speaker 110F that is associated with the sound source 410. As described in detail above, speaker 110F may be associated with sound source 410 by, for example, determining a sound range for the associated sound and then determining that a speaker-associated screen area for speaker 110F is at least partially included within the sound range. Additionally, in the example of FIG. 4A, it can be seen that sound source 410 directly overlays speaker 110F and, therefore, is positioned at a very close distance to speaker 110F. Accordingly, due to the small distance between speaker 110F and sound source 410, a high speaker-associated volume 420 is assigned to speaker 110F for the associated sound. As can be seen in FIG. 4A, the assigned high speaker-associated volume 420 is indicated by the word "HIGH" shown in parentheses adjacent to element number 420. Additionally the assigned high speaker-associated volume 420 is indicated by the large thickly outlined circle surrounding speaker 110F.

Referring now to FIG. 4B, another example is shown in which display screen 125 overlays a speaker array including twenty-four speakers 110A-X. In the example of FIG. 4B, however, a different sound source 410B is positioned at the same screen location as sound source 410A of FIG. 4A. Although sound sources 410A and 410B are positioned at the same screen locations, sound source 410B has a higher volume than sound source 410A. In particular, the higher volume of sound source 410B results in the sound associated with sound source 410B being played by multiple speakers. Specifically, while sound source 410A has a sound played by only speaker 110F, sound source 410B has a sound that is played by speaker 110F as well as surrounding speakers 110A-C, E, G, and I-K. This is shown in FIG. 4B by speaker 110F having a high speaker-associated volume 421 as well as surrounding speakers 110A-C, E, G, and I-K each having a low speaker-associated volume 422. As can be seen in FIG. 4B, the assigned high speaker-associated volume 421 is indicated by the word "HIGH" shown in parentheses adjacent to element number 421, while the assigned low speaker-associated volumes 422 are indicated by the word "LOW" shown in parentheses adjacent to element number 422. Additionally the assigned low speaker-associated volumes 422 are indicated by the thickly outlined circles included inside of speakers 110A-C, E, G, and I-K, which are smaller than the large thickly outlined circle associated with high speaker-associated volume 421 surrounding speaker 110F.

In some examples, a sound source may cover or otherwise apply to a large virtual area such as a room, structure, or other area in which a sound is being made. One example of this may sometimes occur when a character in a video game is running through a hallway, and sounds made by the character may echo throughout the hallway as the character runs through it. In these and other cases, a sound source may sometimes cover a large screen area associated with the large virtual area in which the sound is made. An example of a large sound source screen area is shown in FIG. 4C. In particular, as shown in FIG. 4C, sound source 410C covers a large screen area overlaying multiple speakers 110E-H. In one specific example, sound source 410C may cover a screen area that includes a hallway through which a character is running, and sound source 410C may be associated with a sound made by the running character. In the particular example of FIG. 4C, each speaker 110E-H overlaid by the sound source 410C may be assigned a high speaker-associated volume 423 for the sound associated with sound source 410C.

Figure 5:
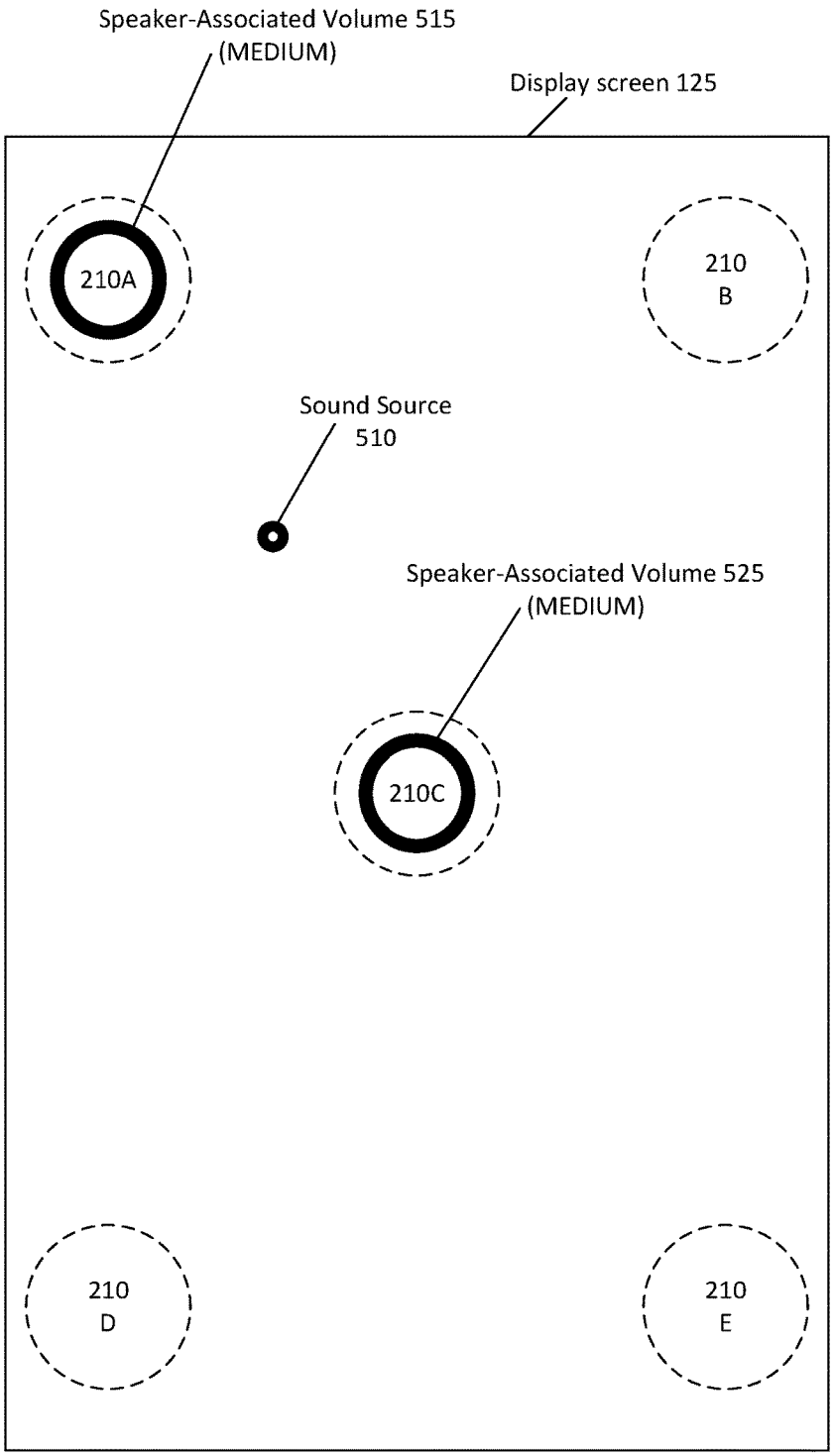
FIG. 5 is a diagram illustrating a first example speaker sound and volume assignment for the example speaker array of FIG. 2 that may be used in accordance with the present disclosure.

FIG. 5 is a diagram illustrating a first example speaker sound and volume assignment for the example speaker array of FIG. 2 that may be used in accordance with the present disclosure. As shown in FIG. 5, display screen 125 overlays a speaker array including five speakers 210A-E. Similar to FIGS. 4A-4C, the speakers 210A-E of FIG. 5 are also depicted using dashed lines because they are positioned behind the display screen 125 and are, therefore, not visible to a viewer looking at the front of the display screen 125. As should be appreciated, the speaker arrangement shown in FIG. 5 is identical to the speaker arrangement depicted previously in FIG. 2.

As also shown in FIG. 5, a sound source 510 is determined to have a screen location indicated by the associated small circular shape shown in FIG. 5. Sound source 510 may include any of the above described or other example sound sources, such as one or more virtual objects (e.g., characters, weapons, vehicles) in a video game or other application, a location of a received or indicated user input, or other event, action, entity or location. In the example, of FIG. 5, there are two speakers (speakers 210A and 210C) that are associated with the sound source 510. As described in detail above, speakers 210A and 210C may be associated with sound source 510 by, for example, determining a sound range for the associated sound and then determining that speaker-associated screen areas for speakers 210A and 210C are at least partially included within the sound range. Additionally, in the example of FIG. 5, it can be seen that sound source 510 is positioned at moderate distances from speakers 210A and 210C (e.g., approximately halfway between speakers 210A and 210C). Accordingly, due to the moderate distances between each of speakers 210A and 210C and sound source 510, medium speaker-associated volumes 515 and 525 are assigned to both speakers 210A and 210C for the associated sound. As can be seen in FIG. 5, the assigned medium speaker-associated volumes 515 and 525 are indicated by the word "MEDIUM" shown in parentheses adjacent to element numbers 515 and 525. Additionally the assigned medium speaker-associated volumes 515 and 525 are indicated by the thickly outlined circles included inside of speakers 210A and 210C, which are approximately half the size of the large thickly outlined circle associated with high speaker-associated volume 420 of FIG. 4A.

Figure 6:
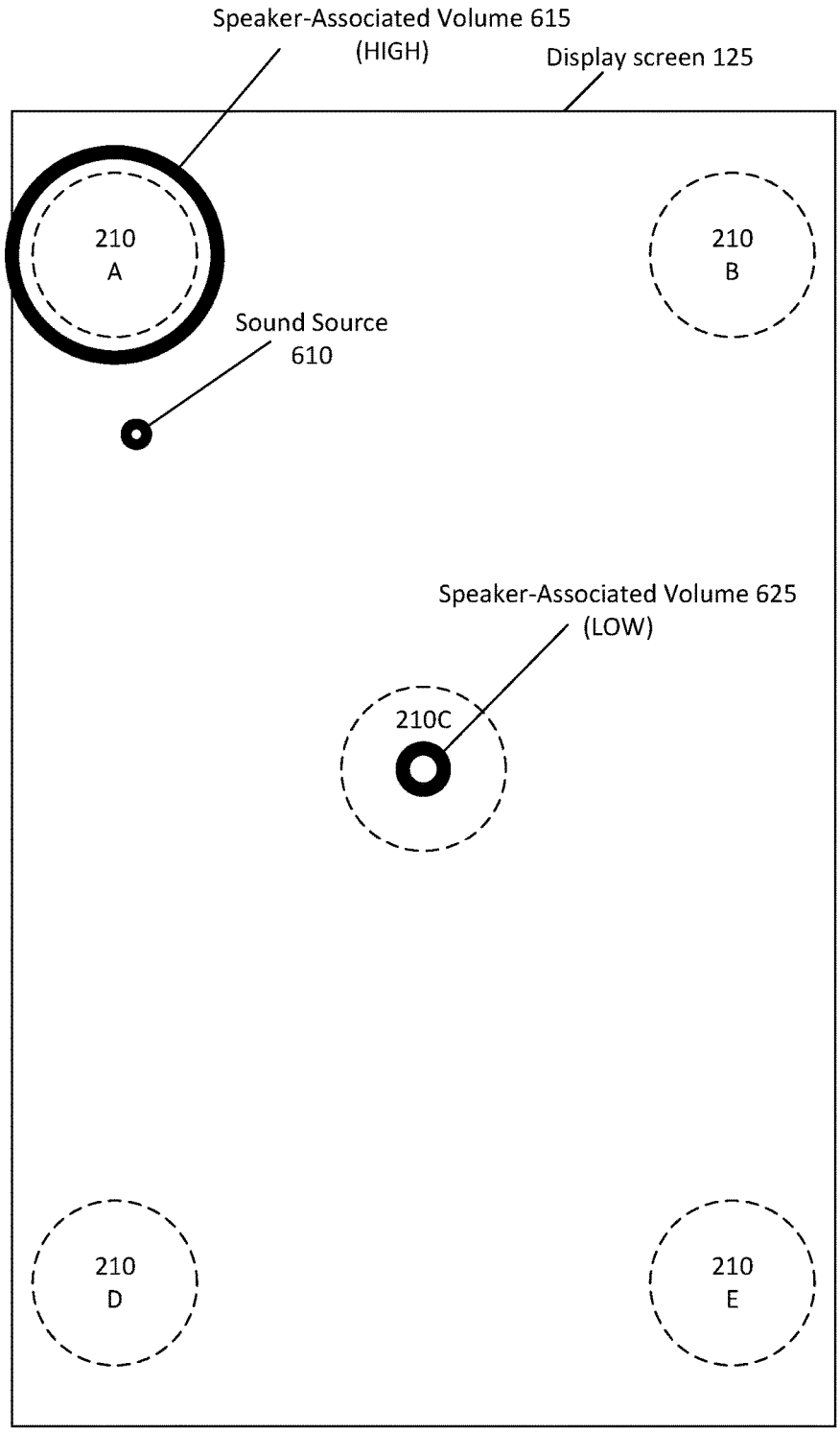
FIG. 6 is a diagram illustrating a second example speaker sound and volume assignment for the example speaker array of FIG. 2 that may be used in accordance with the present disclosure.

FIG. 6 is a diagram illustrating a second example speaker sound and volume assignment for the example speaker array of FIG. 2 that may be used in accordance with the present disclosure. As shown in FIG. 6, display screen 125 overlays a speaker array including five speakers 210A-E. As also shown in FIG. 6, a sound source 610 is determined to have a screen location indicated by the associated small circular shape shown in FIG. 6. In the example, of FIG. 6, there are two speakers (speakers 210A and 210C) that are associated with the sound source 610. As described in detail above, speakers 210A and 210C may be associated with sound source 610 by, for example, determining a sound range for the associated sound and then determining that speaker-associated screen areas for speakers 210A and 210C are at least partially included within the sound range. Additionally, in the example of FIG. 6, it can be seen that sound source 610 is positioned significantly closer to 210A than to speaker 210C. Accordingly, due to the relatively short distance between speaker 210A and sound source 610, a high speaker-associated volume 615 is assigned to speaker 210A for the associated sound. As can be seen in FIG. 6, the assigned high speaker-associated volumes 615 is indicated by the word "HIGH" shown in parentheses adjacent to element number 615. Additionally the assigned high speaker-associated volume 615 is indicated by the large thickly outlined circle surrounding speaker 210A. Furthermore, due to the relatively large distance between speaker 210C and sound source 610, a low speaker-associated volume 625 is assigned to speaker 210C for the associated sound. As can be seen in FIG. 6, the assigned low speaker-associated volumes 625 is indicated by the word "LOW" shown in parentheses adjacent to element number 625. Additionally the assigned low speaker-associated volume 625 is indicated by the small thickly outlined circle inside of speaker 210C.

Thus, as set forth above, speaker sound assignment components 312 may determine one or more associated speakers for playing of a particular sound and also, in some cases, a respective speaker-associated volume for the sound for each associated speaker. It is noted, however, that associated speakers may not necessarily play the exact associated sound at its respective speaker-associated volume. One reason for this is that speakers may often be selected to concurrently play multiple different sounds from multiple different sound sources. Thus, in these and other cases, speakers may sometimes play a resulting sound that is a combination of various different individual sounds. Additionally, a resulting sound that is played by a particular speaker may sometimes have a resulting volume that differs from the associated-speaker volumes of individual sounds that are combined into the resulting sound.

Referring back to FIG. 3, it is seen that system 300 includes resulting speaker sound determination components 316, which may determine resulting sounds and volumes that are played by the speakers in the speaker array 115. As set forth above, in some examples, the resulting speaker sound and volume may be determined based, at least in part, on one or more individual assigned sounds and their respective speaker-associated volumes. For a simple case in which only a single individual sound is assigned to a speaker, then, in some examples, the speaker's resulting sound and volume may be determined based, at least in part, on the individual sound and its speaker-associated volume. However, for cases in which multiple individual sounds are assigned to a speaker, the resulting sound and volume determinations may often be more complex. A number of different techniques may be employed for combining various individual sounds and volumes into a resulting combination sound and volume that is played by a particular speaker. For example, in some cases, a weighting technique may be employed in which individual sounds with higher speaker-associated volumes are assigned a higher weight and, therefore, have a greater influence over the resulting combination sound than lower weighted individual sounds. Additionally, in some cases, individual sounds may be combined based, at least in part, on one or more characteristics, such as frequency, pitch, tone, and the like. For example, in some cases, individual sounds having one or more similar characteristics may experience a higher degree of blending into the resulting sound than individual sounds with dissimilar characteristics. Additionally, a resulting combination volume may be based on a number of sounds and their respective speaker-associated volumes. Generally, speakers having larger numbers of individual sounds with higher speaker-associated volumes may sometimes tend to have a higher resulting combination volume, while speakers having lesser numbers of individual sounds with lower speaker-associated volumes may sometimes tend to have a lower resulting combination volume.

Various other factors may also, in some examples, contribute to determination of a resulting speaker sound and volume. For example, the resulting speaker sounds and volumes may sometimes be determined based on factors such as a position of a human listener with respect to a speaker, components or materials between the human listener and the speakers that modify the sound as it is heard by the listener, and the like. Some examples of these and other factors are described above, such as with respect to speaker information components 314, and are not repeated here.

It is noted that, in some examples, the components shown in FIG. 3 may be implemented using a single node or device, such as a client device, or may be distributed across any number of different nodes or devices. For example, in some cases, certain components (or portions of components) shown in FIG. 3 may execute on a client, while other components (or portions of components) shown in FIG. 3 may execute on one or more servers. In some examples, such an arrangement may improve efficiency by allowing certain operations, such as operations that require more complex calculations and/or greater computing resources, to be performed on a server, while allowing other operations to be performed locally at the client. In some cases, operations performed, at least in part, at the server may include, for example and without limitation, triangulation or other audio location determination techniques for speakers, determination of screen locations for various sound sources, combinations of individual sounds into resulting sounds, and others.

Figure 7:
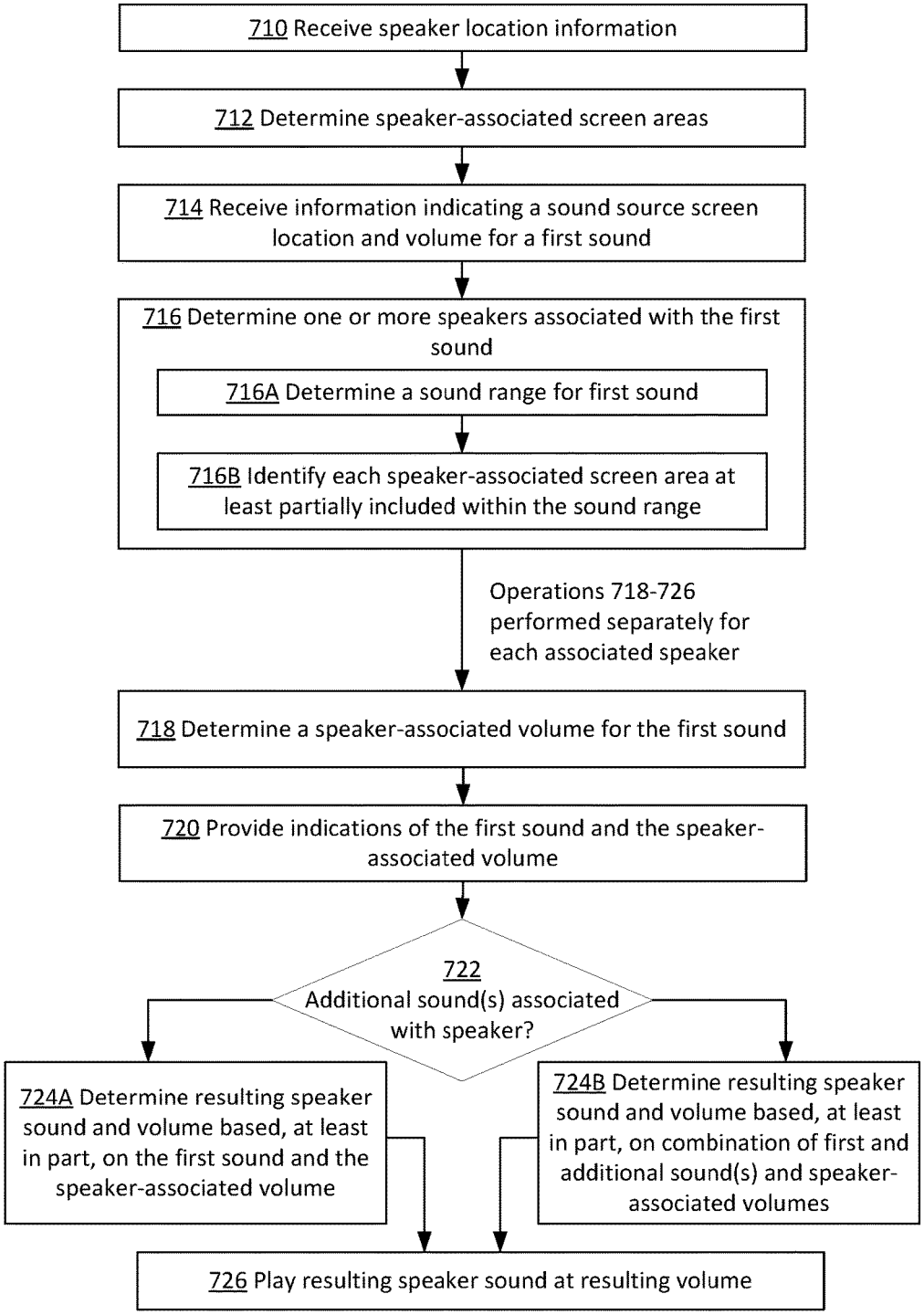
FIG. 7 is a diagram illustrating an example process for process for operating behind screen speakers that may be used in accordance with the present disclosure.

FIG. 7 is a diagram illustrating an example process for operating behind screen speakers that may be used in accordance with the present disclosure. At operation 710, speaker information is received. As set forth, the speaker information may, for example, indicate a number of speakers included in a behind screen speaker array and the locations of the speakers. The locations of the speakers may be indicated, for example, relative to the display screen. In some examples, the speaker information may be received by speaker information components 314, for example by accessing stored information, by receiving information from a user, and/or by receiving audio data from an attached microphone. As set forth above, in some examples, speaker location and other speaker information may be known or accessible based on a type of system or device in which the speakers are included. Also, in some examples, speaker location and other speaker information may be determined based on triangulation or other known audio source location determination techniques, such as by instructing one or more speakers to play various sounds and collecting audio data associated with the playing of those sounds.

At operation 712, speaker-associated screen areas are determined. In some examples, speaker-associated screen areas may be determined by speaker information components 314 based, at least in part, on the speaker information received at operation 710. As set forth above, a speaker-associated screen area is a portion of the display screen that is associated with one or more respective speakers. In some examples, a speaker-associated screen area may be a portion of the display screen that overlays a respective speaker. Also, in some examples, the entire display screen may be divided up into speaker-associated screen areas such that each speaker-associated screen area may include all points on a display screen that are closer to a respective speaker than to any other speaker. Other example criteria and techniques for determining speaker-associated screen areas are described in detail above and are not repeated here. In some examples, upon determination of speaker-associated screen areas, information indicating the speaker associated screen areas may be provided to and received by one or more components, such as speaker sound assignment components 312, resulting speaker sound determination components 316, and others.

At operation 714, information is received indicating a sound source screen location and volume for a first sound. As set forth above, in some examples, the sound source for the first sound may include one or more virtual objects (e.g., a character, weapon, vehicle, structure, object of nature, etc.), and the sound source screen location may be associated with the virtual object(s). Thus, in some examples, the information received at operation 714 may include screen coordinates or other location information for a virtual object. For example, the virtual object may be included within a virtual area that is associated with a video game or other application. In some examples, the information received at operation 714 may be determined based, at least in part, on information regarding a viewport and a location of the first sound source in association with a two-dimensional or three-dimensional model of a virtual area. Some examples of viewport and model information and their use in determining a sound source screen location are described in detail above and are not repeated here.

As also set forth above, in some examples, the first screen location may be associated with user input, and the first sound may relate to audio feedback associated with the user input. Thus, in some examples, the information received at operation 714 may include screen coordinates or other location information for which a user provides input or for other actions, events, or inputs. For example, in some cases, a user may select a virtual object within a program or other interface, such as a menu item or icon, and audio and other feedback may be provided to confirm the user's selection. As another example, a user may select a virtual object within a video game, such as weapon or character, and audio or other selection feedback may similarly be provided. As yet another example, a user may select a particular screen area as a location to move, drop, or insert a virtual object, and audio or other selection feedback may similarly be provided to confirm the selected location. As also set forth above, in addition to audio feedback, other feedback, such as visual and/or haptic feedback (e.g. a rumble, vibration, etc.) may also be provided in association with user input.

At operation 716, one or more speakers associated with the first sound are determined, for example based, at least in part, on the sound source screen location for the first sound, the volume for the first sound, and the speaker-associated screen areas. In the example of FIG. 7, operation 716 includes sub-operations 716A and 716B. In particular, at operation 716A, a sound range is determined for the first sound. As set forth above, the sound range is a screen area surrounding or partially surrounding a sound source that is used to associate one or more speakers with an associated sound. As also set forth above, in some examples, the sound range may be determined based, at least in part, on the screen location of the sound source and the volume of an associated sound. The size of a sound range may, in some cases, be determined primarily based on the volume of sound. In particular, sounds with higher volumes may generally tend to be detectable at greater distances from their sources and may, therefore, tend to have lager sound ranges. By contrast, sounds with lower volumes may generally tend to be detectable only at lesser distances from their sources and may, therefore, tend to have smaller sound ranges. In some examples, a sound range may be a circular area that surrounds a respective sound source, with the sound source at the center of the circular sound range. In some cases, however, one or more sound-blocking or sound-resistant elements may block or reduce the extension of the sound range from the sound source in one or more directions. Various additional example aspects of sound range determination are described in detail above and are not repeated here.

In some examples, the one or more speakers associated with the first sound may then be determined based, at least in part, on the sound range determined at sub-operation 716A. For example, at sub-operation 716B, each speaker-associated screen area that is at least partially included within the sound range is identified. For example, sub-operation 716B may include comparing areas defined by various screen coordinates or other location information for the sound range to areas defined by various screen coordinates or other location information for the speaker-associated screen areas and then identifying when such areas may at least partially overlap one another. The associated speakers may then be determined based, at least in part, on the one or more speaker-associated screen areas identified at sub-operation 716B. In particular, each speaker having a respective identified speaker-associated screen area that is at least partially included within the sound range may be associated with the sound.

As shown in FIG. 7, operations 718-726, which constitute the bottom portion of the flowchart of FIG. 7, are performed separately for each associated speaker. In particular, at operation 718, a speaker-associated volume is determined for the first sound. As set forth above, the speaker-associated volume may be determined based, at least in part, on the sound source screen location for the first sound, the volume for the first sound, and the speaker-associated screen area for the speaker. In particular, in some examples, the speaker-associated volume may be determined based, at least in part, on a distance between the speaker-associated screen area and the sound source. For example, in some cases, associated speakers that are closer to the sound source may play the sound at a higher speaker-associated volume, while associated speakers that are further from the sound source may play the sound at a lower speaker-associated volume. It is noted, however, that additional factors, such as locations of sound-obstructing or sound-blocking virtual objects, may also affect the determination of the speaker-associated volume. Another characteristic based upon which the speaker-associated volumes may sometimes be determined is a virtual distance between the sound source and a viewport through which a displayed virtual area is viewed. Various additional example aspects of speaker-associated volume determination are described in detail above and are not repeated here.

At operation 720, indications of the first sound and the speaker-associated volume are provided, for example for playing of a resulting speaker sound at a resulting speaker volume. As set forth above, the speaker-associated volume may be determined, in some examples, by speaker sound assignment components 312, which may, in turn, provide an indication of the indications of the first sound and the speaker-associated volume to resulting speaker sound determination components 316 for determination of a resulting speaker sound and resulting volume.

At operation 722, it is determined whether there are additional sounds associated with the speaker, such as sounds occurring concurrently or at least partially concurrently with the first sound. If there are no additional associated sounds, then, at operation 724B, a resulting speaker sound and resulting volume are determined based, at least in part, on the first sound and the speaker-associated volume. On the other hand, if there are one or more additional associated sounds, then, at operation 724B, a resulting speaker sound and resulting volume are determined based, at least in part, on a combination of first sound and the additional sound and the speaker-associated volumes. Various example techniques for combining individual sounds into a resulting speaker sound are described in detail above and are not repeated here. Additionally, various example techniques for determining a resulting speaker volume based on individual sound volumes are described in detail above and are not repeated here. Furthermore, as set forth above, various other factors may also contribute to determination of a resulting speaker sound and/or volume, such as a position of a human listener with respect to a speaker, components or materials between the human listener and a speaker that modify the sound as it is heard by the listener, and the like.

At operation 726, the resulting speaker sound is played at the resulting volume. In some examples, the resulting speaker sound may be played concurrently with a display of a virtual area and/or virtual objects with which the resulting sound is at least partially associated. Also, in some examples, the resulting speaker sound may be played in close time proximity with the receiving of user input with which the resulting sound is at least partially associated. Furthermore, the resulting sound may be played in combination with visual, haptic, and other forms of feedback or output.

As a specific example of some of the operations shown in FIG. 7, it is noted that, in some cases, a display screen be divided into multiple speaker-associated screen areas using one or more spatial partitioning techniques. One example spatial partitioning technique described above includes assigning each speaker-associated screen area to include all points on a display screen that are closer to a respective speaker than to any other speaker. This type of spatial partitioning technique may, in some cases, be represented using a Voronoi diagram. In a Voronoi diagram, a plane is partitioned into multiple cells each associated with a seed, and each cell is assigned to include all points on the plane that are closer to a respective seed than to any other seed. In some examples, a Voronoi diagram and/or associated data may be generated to represent a display screen, and each cell of the Voronoi diagram may represent a respective speaker-associated screen area. Additionally, a sound source location may be indicated on the Voronoi diagram at a location that represents the screen location of the sound source. Furthermore, a sound range may also be formed on the Voronoi diagram to represent the sound range for the sound. As set forth above, in some examples, the sound range may be a circle that surrounds the sound source. In some examples, operation 716 of FIG. 7 may include conducting a number of circle-polygon collision tests to identify all cells in the Voronoi diagram that at least partially overlap with the sound range. These identified cells may represent speaker-associated screen areas for the speakers that are associated with the sound. In some examples, operation 718 may be performed for each at least partially overlapping cell by calculating a percentage of the cell that is overlapped by the sound range. The speaker-associated volume for the sound may then be determined based on the percentage of overlap of the cell. For example, cells with a higher percentage of overlap may have a higher speaker-associated volume, while cells with a lower percentage of overlap may have a lower speaker-associated volume.

Figure 8:
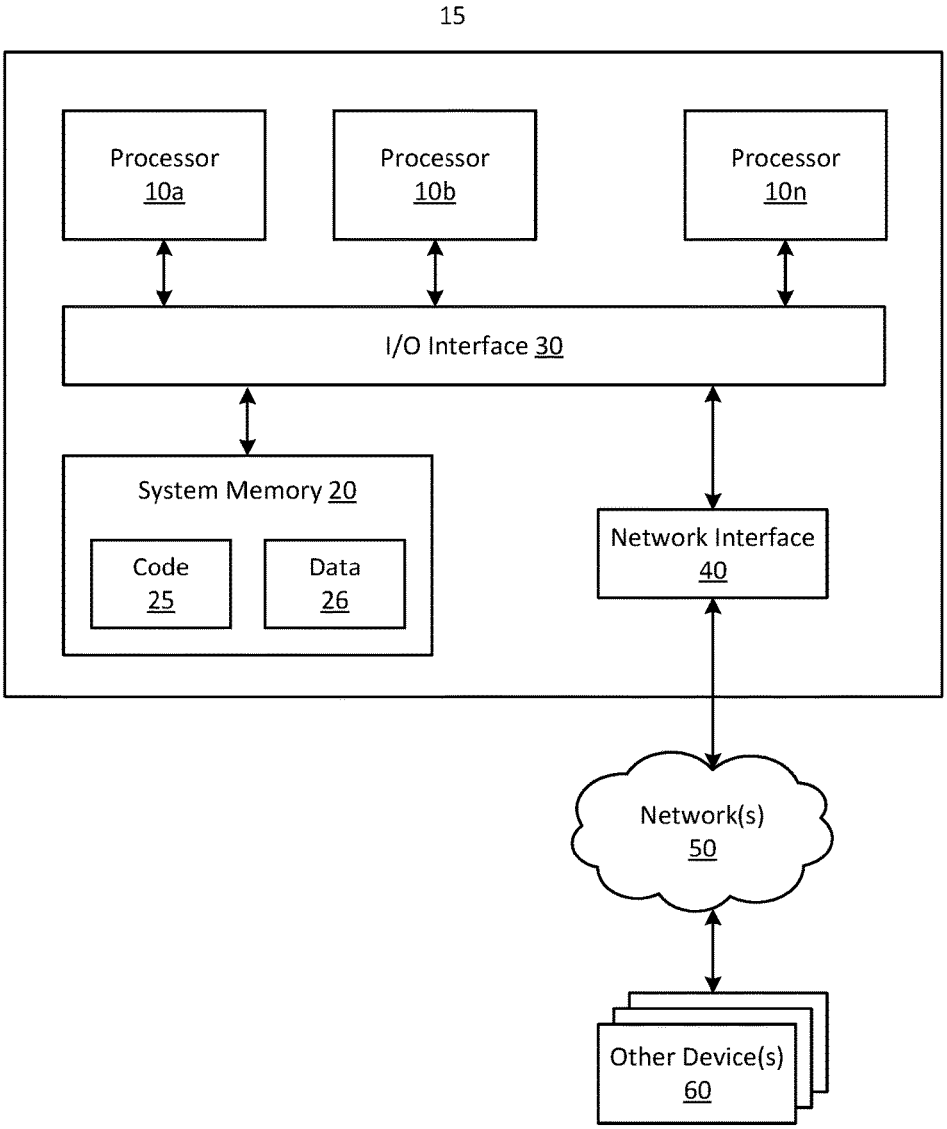
FIG. 8 is a diagram illustrating an example computing system that may be used in accordance with the present disclosure.

FIG. 8 depicts a computer system that includes or is configured to access one or more computer-accessible media. In the illustrated embodiment, computing device 15 includes one or more processors 10*a*, 10*b* and/or 10*n* (which may be referred herein singularly as "a processor 10" or in the plural as "the processors 10") coupled to a system memory 20 via an input/output (I/O) interface 30. Computing device 15 further includes a network interface 40 coupled to I/O interface 30.

In various embodiments, computing device 15 may be a uniprocessor system including one processor 10 or a multiprocessor system including several processors 10 (e.g., two, four, eight or another suitable number). Processors 10 may be any suitable processors capable of executing instructions. For example, in various embodiments, processors 10 may be embedded processors implementing any of a variety of instruction set architectures (ISAs), such as the x86, PowerPC, SPARC or MIPS ISAs or any other suitable ISA. In multiprocessor systems, each of processors 10 may commonly, but not necessarily, implement the same ISA.

System memory 20 may be configured to store instructions and data accessible by processor(s) 10. In various embodiments, system memory 20 may be implemented using any suitable memory technology, such as static random access memory (SRAM), synchronous dynamic RAM (SDRAM), nonvolatile/Flash®-type memory or any other type of memory. In the illustrated embodiment, program instructions and data implementing one or more desired functions, such as those methods, techniques and data described above, are shown stored within system memory 20 as code 25 and data 26.

In one embodiment, I/O interface 30 may be configured to coordinate I/O traffic between processor 10, system memory 20 and any peripherals in the device, including network interface 40 or other peripheral interfaces. In some embodiments, I/O interface 30 may perform any necessary protocol, timing or other data transformations to convert data signals from one component (e.g., system memory 20) into a format suitable for use by another component (e.g., processor 10). In some embodiments, I/O interface 30 may include support for devices attached through various types of peripheral buses, such as a variant of the Peripheral Component Interconnect (PCI) bus standard or the Universal Serial Bus (USB) standard, for example. In some embodiments, the function of I/O interface 30 may be split into two or more separate components, such as a north bridge and a south bridge, for example. Also, in some embodiments some or all of the functionality of I/O interface 30, such as an interface to system memory 20, may be incorporated directly into processor 10.

Network interface 40 may be configured to allow data to be exchanged between computing device 15 and other device or devices 60 attached to a network or networks 50, such as other computer systems or devices, for example. In various embodiments, network interface 40 may support communication via any suitable wired or wireless general data networks, such as types of Ethernet networks, for example. Additionally, network interface 40 may support communication via telecommunications/telephony networks, such as analog voice networks or digital fiber communications networks, via storage area networks such as Fibre Channel SANs (storage area networks) or via any other suitable type of network and/or protocol.

In some embodiments, system memory 20 may be one embodiment of a computer-accessible medium configured to store program instructions and data as described above for implementing embodiments of the corresponding methods and apparatus. However, in other embodiments, program instructions and/or data may be received, sent or stored upon different types of computer-accessible media. Generally speaking, a computer-accessible medium may include non-transitory storage media or memory media, such as magnetic or optical media—e.g., disk or DVD/CD coupled to computing device 15 via I/O interface 30. A non-transitory computer-accessible storage medium may also include any volatile or non-volatile media, such as RAM (e.g., SDRAM, DDR SDRAM, RDRAM, SRAM, etc.), ROM (read only memory) etc., that may be included in some embodiments of computing device 15 as system memory 20 or another type of memory. Further, a computer-accessible medium may include transmission media or signals such as electrical, electromagnetic or digital signals conveyed via a communication medium, such as a network and/or a wireless link, such as those that may be implemented via network interface 40.

A compute node, which may be referred to also as a computing node, may be implemented on a wide variety of computing environments, such as commodity-hardware computers, virtual machines, web services, computing clusters and computing appliances. Any of these computing devices or environments may, for convenience, be described as compute nodes.

In addition, certain methods or process blocks may be omitted in some implementations. The methods and processes described herein are also not limited to any particular sequence, and the blocks or states relating thereto can be performed in other sequences that are appropriate. For example, described blocks or states may be performed in an order other than that specifically disclosed, or multiple blocks or states may be combined in a single block or state. The example blocks or states may be performed in serial, in parallel or in some other manner. Blocks or states may be added to or removed from the disclosed example embodiments.

It will also be appreciated that various items are illustrated as being stored in memory or on storage while being used, and that these items or portions thereof may be transferred between memory and other storage devices for purposes of memory management and data integrity. Alternatively, in other embodiments some or all of the software modules and/or systems may execute in memory on another device and communicate with the illustrated computing systems via inter-computer communication. Furthermore, in some embodiments, some or all of the systems and/or modules may be implemented or provided in other ways, such as at least partially in firmware and/or hardware, including, but not limited to, one or more application-specific integrated circuits (ASICs), standard integrated circuits, controllers (e.g., by executing appropriate instructions, and including microcontrollers and/or embedded controllers), field-programmable gate arrays (FPGAs), complex programmable logic devices (CPLDs), etc. Some or all of the modules, systems and data structures may also be stored (e.g., as software instructions or structured data) on a computer-readable medium, such as a hard disk, a memory, a network or a portable media article to be read by an appropriate drive or via an appropriate connection. The systems, modules and data structures may also be transmitted as generated data signals (e.g., as part of a carrier wave or other analog or digital propagated signal) on a variety of computer-readable transmission media, including wireless-based and wired/cable-based media, and may take a variety of forms (e.g., as part of a single or multiplexed analog signal, or as multiple discrete digital packets or frames). Such computer program products may also take other forms in other embodiments. Accordingly, the present invention may be practiced with other computer system configurations.

Conditional language used herein, such as, among others, "can," "could," "might," "may," "e.g." and the like, unless specifically stated otherwise, or otherwise understood within the context as used, is generally intended to convey that certain embodiments include, while other embodiments do not include, certain features, elements, and/or steps. Thus, such conditional language is not generally intended to imply that features, elements and/or steps are in any way required for one or more embodiments or that one or more embodiments necessarily include logic for deciding, with or without author input or prompting, whether these features, elements and/or steps are included or are to be performed in any particular embodiment. The terms "comprising," "including," "having" and the like are synonymous and are used inclusively, in an open-ended fashion, and do not exclude additional elements, features, acts, operations and so forth. Also, the term "or" is used in its inclusive sense (and not in its exclusive sense) so that when used, for example, to connect a list of elements, the term "or" means one, some or all of the elements in the list.

While certain example embodiments have been described, these embodiments have been presented by way of example only and are not intended to limit the scope of the inventions disclosed herein. Thus, nothing in the foregoing description is intended to imply that any particular feature, characteristic, step, module or block is necessary or indispensable. Indeed, the novel methods and systems described herein may be embodied in a variety of other forms; furthermore, various omissions, substitutions and changes in the form of the methods and systems described herein may be made without departing from the spirit of the inventions disclosed herein. The accompanying claims and their equivalents are intended to cover such forms or modifications as would fall within the scope and spirit of certain of the inventions disclosed herein.

What is claimed is:

1. A computing system for operating a plurality of speakers comprising:

a display screen;

the plurality of speakers each positioned at least partially behind the display screen;

one or more processors; and one or more memories having stored therein instructions that, upon execution by the one or more processors, cause the computing system perform operations comprising:

receiving information indicating a plurality of speaker-associated screen areas for the plurality of speakers;

receiving information indicating a first volume of a first sound associated with a first sound source;

determining a first screen location of the first sound source based, at least in part, on information regarding a virtual camera and a location of the first sound source in association with a model of a virtual area of a video game;

determining, based at least in part on the first screen location and the first volume, a sound range for the first sound;

identifying one or more speaker-associated screen areas at least partially included within the sound range;

determining, based at least in part on the one or more speaker-associated screen areas at least partially included within the sound range, one or more speakers associated with the first sound;

for each speaker associated with the first sound:

determining, based at least in part on the first screen location, the first volume, and a speaker-associated screen area for the speaker, a respective speaker-associated volume for the first sound; and providing an indication of the first sound and the respective speaker-associated volume for playing of a resulting sound at a resulting volume.

2. The computing system of claim 1, wherein the first sound source includes a first virtual object associated with the first screen location.

3. The computing system of claim 1, wherein the first screen location is associated with user input, and wherein the first sound relates to audio feedback associated with the user input.

4. A method for operating a plurality of speakers comprising:

receiving information indicating a plurality of speaker-associated screen areas for the plurality of speakers each positioned at least partially behind a display screen;

receiving information indicating a first volume of a first sound associated with a first sound source;

determining a first screen location of the first sound source based, at least in part, on information regarding a virtual camera and a location of the first sound source in association with a model of a virtual area of a video game;

determining, based at least in part on the first screen location and the first volume, a sound range for the first sound;

determining, based at least in part on the sound range, one or more speakers associated with the first sound; and for each speaker associated with the first sound, providing an indication of the first sound for playing of a resulting sound determined based, at least in part, on the first sound.

5. The method of claim 4, wherein the first sound source includes a first virtual object associated with the first screen location.

6. The method of claim 4, wherein the first screen location is associated with user input, and wherein the first sound relates to audio feedback associated with the user input.

7. The method of claim 6, further comprising providing haptic feedback associated with the user input in addition to the audio feedback.

8. The method of claim 4, wherein the resulting sound is a combination of the first sound and at least one other sound.

9. The method of claim 4, further comprising, for each speaker associated with the first sound:

determining, based at least in part on the first screen location, the first volume, and a speaker-associated screen area for the speaker, a respective speaker-associated volume for the first sound; and providing an indication of the respective speaker-associated volume for playing of the resulting sound at a resulting volume.

10. The method of claim 9, wherein the speaker-associated volume is determined based in part on a virtual distance between the first sound source and the virtual camera.

11. One or more non-transitory computer-readable storage media having stored thereon instructions that, upon execution by one or more compute nodes, cause the one or more compute nodes to perform operations comprising:

receiving information indicating a plurality of speaker-associated screen areas for a plurality of speakers;

receiving information indicating a first volume of a first sound associated with a first sound source;

determining a first screen location of the first sound source based, at least in part, on information regarding a virtual camera and a location of the first sound source in association with a model of a virtual area of a video game;

determining, based at least in part on the first screen location, the first volume, and the speaker-associated screen areas, one or more speakers associated with the first sound for each speaker associated with the first sound:

determining a respective speaker-associated volume for the first sound; and providing an indication of the first sound and the respective speaker-associated volume for playing of a resulting sound at a resulting volume.

12. The one or more non-transitory computer-readable storage media of claim 11, wherein the first sound source includes a first virtual object associated with the first screen location.

13. The one or more non-transitory computer-readable storage media of claim 11, wherein the first screen location is associated with user input, and wherein the first sound relates to audio feedback associated with the user input.

14. The one or more non-transitory computer-readable storage media of claim 13, further comprising providing haptic feedback associated with the user input in addition to the audio feedback.

15. The one or more non-transitory computer-readable storage media of claim 11, wherein the resulting sound is a combination of the first sound and at least one other sound.

16. The one or more non-transitory computer-readable storage media of claim 11, wherein the speaker-associated volume is determined based in part on a virtual distance between the first sound source and the virtual camera.

17. The one or more non-transitory computer-readable storage media of claim 11, wherein determining, based at least in part on the first screen location, the first volume, and the speaker-associated screen areas, one or more speakers associated with the first sound comprises:

determining, based at least in part on the first screen location and the first volume, a sound range for the first sound;

identifying one or more speaker-associated screen areas at least partially included within the sound range; and determining, based at least in part on the one or more speaker-associated screen areas at least partially included within the sound range, the one or more speakers associated with the first sound.

* * * * *